US008192379B2

(12) United States Patent
Huang

(10) Patent No.: US 8,192,379 B2
(45) Date of Patent: Jun. 5, 2012

(54) SINGLE-MOTOR MASSAGER

(76) Inventor: Chien-Ming Huang, Taipei (TW)

( * ) Notice: Subject to any disclaimer, the term of this patent is extended or adjusted under 35 U.S.C. 154(b) by 1027 days.

(21) Appl. No.: 12/139,371

(22) Filed: Jun. 13, 2008

(65) Prior Publication Data

US 2009/0312678 A1 Dec. 17, 2009

(51) Int. Cl.
*A61H 19/00* (2006.01)

(52) U.S. Cl. ..... 601/99; 601/100; 601/101

(58) Field of Classification Search ..... 601/22, 601/27–31, 46, 49, 50, 61, 70, 86, 87, 95, 601/99, 100, 101, 134
See application file for complete search history.

(56) References Cited

U.S. PATENT DOCUMENTS 5,807,288 A * 9/1998 Wu ..... 601/99
5,877,570 A * 3/1999 Chen ..... 310/75 R
5,971,944 A * 10/1999 Chang ..... 601/90
6,083,180 A * 7/2000 Shimizu ..... 601/50
7,179,240 B2 * 2/2007 Wu ..... 601/99
2005/0245851 A1 * 11/2005 Ferber et al. ..... 601/86

* cited by examiner

*Primary Examiner* — Michael A. Brown
(74) *Attorney, Agent, or Firm* — patenttm.us

(57) ABSTRACT

A single-motor massager has a base, a carriage, a gear shaft assembly, a massager assembly and a motor. The base has two gear racks. The carriage is mounted movably on the base. The gear shaft assembly is mounted on the carriage and is mounted movably on the gear racks of the base. The massaging assembly is mounted on the carriage and connects to the gear shaft assembly. The motor drives the massaging assembly of the massager assembly to provide massaging function and to move the carriage and the gear shaft assembly and the massaging assembly along the base. With the two gear racks, the massaging assembly moves stably. With only one motor and the simplified gear shaft assembly and massager assembly, the manufacturing process of the massager is simplified and the cost of the massager is reduced.

20 Claims, 12 Drawing Sheets

SINGLE-MOTOR MASSAGER

BACKGROUND OF THE INVENTION

1. Field of the Invention

The present invention relates to a massager, particularly to a single-motor massager having a simplified structure.

2. Description of the Prior Arts

Body massagers are widely used to massage the users to make the users feel relax and comfortable. A conventional body massager has a massage assembly moving back and forth to massage a wide area of the body of the user. However, the conventional body massager needs to have many and complicated components to move the massage assembly. Due to the complexities of the conventional body massager, the manufacturing process of the conventional body massager is complicated and the prime cost of the body massager is high.

Furthermore, to provide a larger-ranged massage function, the conventional body massager requires two motors. One of the motors moves the massage assembly back and forth, and the other one of the motors provides the massage function. Therefore, the conventional body massager needs a complicated guide system to stable the movement of the massage assembly. Thus, the complicated guide system also needs complicated manufacturing process and costs high.

To overcome the shortcomings, the present invention provides a single-motor massager to mitigate or obviate the aforementioned problems.

SUMMARY OF THE INVENTION

The main objective of the present invention is to provide a single-motor massager to decrease the prime cost and enhance the performance of the massaging motion.

A single-motor massager has a base, a carriage, a gear shaft assembly, a massager assembly and a motor. The base has two gear racks mounted on the base. The carriage is mounted movably on the base. The gear shaft assembly is mounted on the carriage, and is mounted movably on the gear racks of the base.

The gear shaft assembly has a rod, two gears and an inclined gear. The rod is mounted rotatably on the carriage and mounted across the gear racks of the base. The gears are attached securely and respectively to the two ends of the rod and mounted rotatably on the gear racks of the base. The inclined gear is mounted securely around the rod and has inclined teeth.

The massage assembly is mounted on the carriage and has a main gear drive and a main massaging device. The main gear drive has an inclined gear connecting to the gear shaft assembly and engaging the inclined gear of the gear shaft assembly. The main massaging device connects to and is rotated by the main gear drive. The motor is mounted securely on the carriage and has a worm rod extending out of the motor and meshed with the main gear drive.

When a user turns on the single-motor massager, the motor rotates the main massaging device of the massage assembly to provide the user a massage function. Furthermore, the main gear drive of the massage assembly drives the gear shaft assembly to move along the two gear racks on the base. Therefore, the single-motor massager provides a large area massage function. Because the gear racks are in pair and set equally, the gear shaft assembly moves along the gear racks smoothly and stably. Moreover, only one motor and simplified gear drives are needed, the manufacturing process of the massager is simplified and the cost of the massager is reduced.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
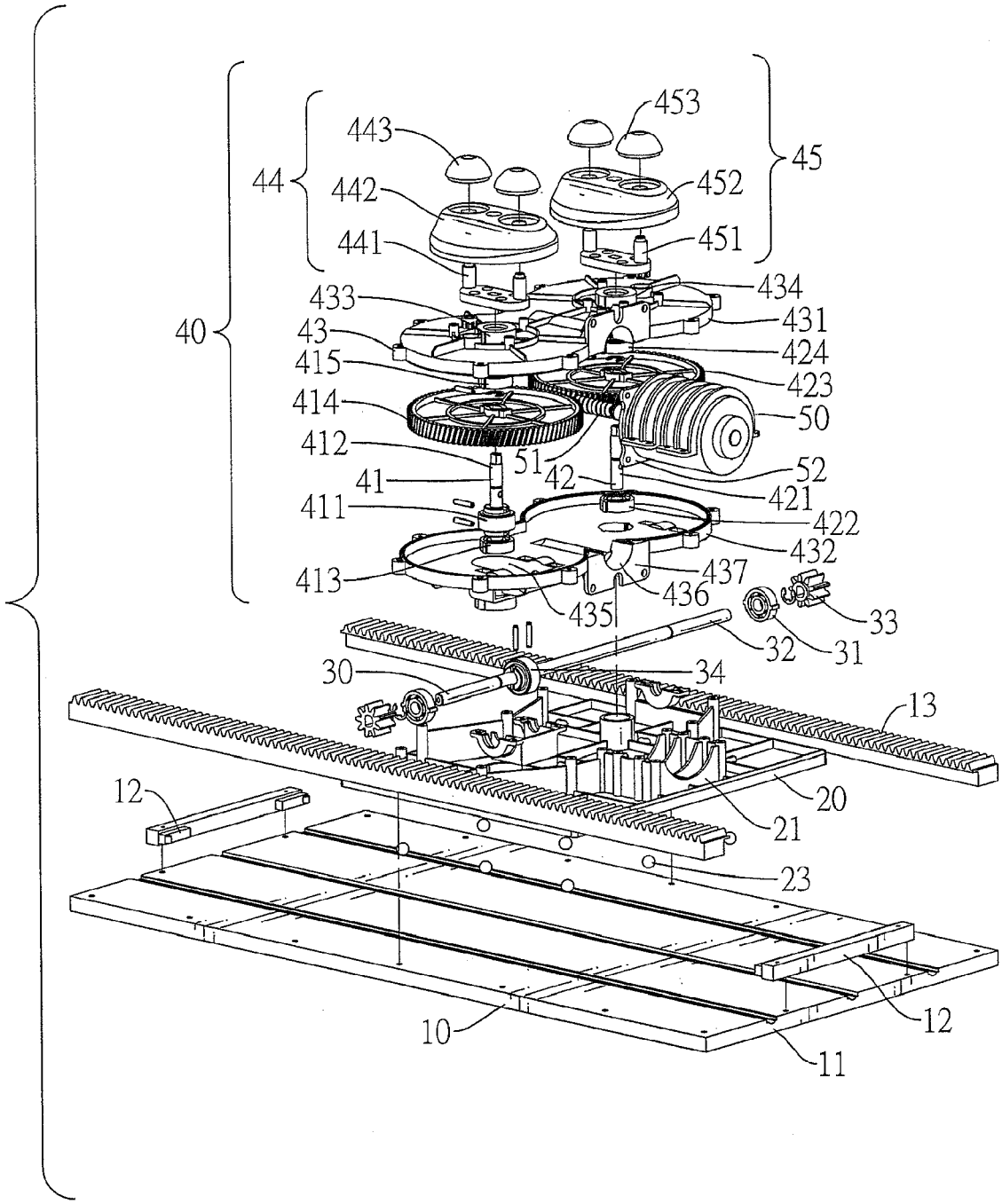
FIG. 1 is an exploded perspective view of a simplified single-motor massager in accordance with the present invention.

With reference to FIGS. 1, 2, 5 and 7, a single-motor massager in accordance with the present invention comprises a base (10), a carriage (20), a gear shaft assembly (30), a massage assembly (40), a motor (50) and an outer cover (60).

Figure 2:
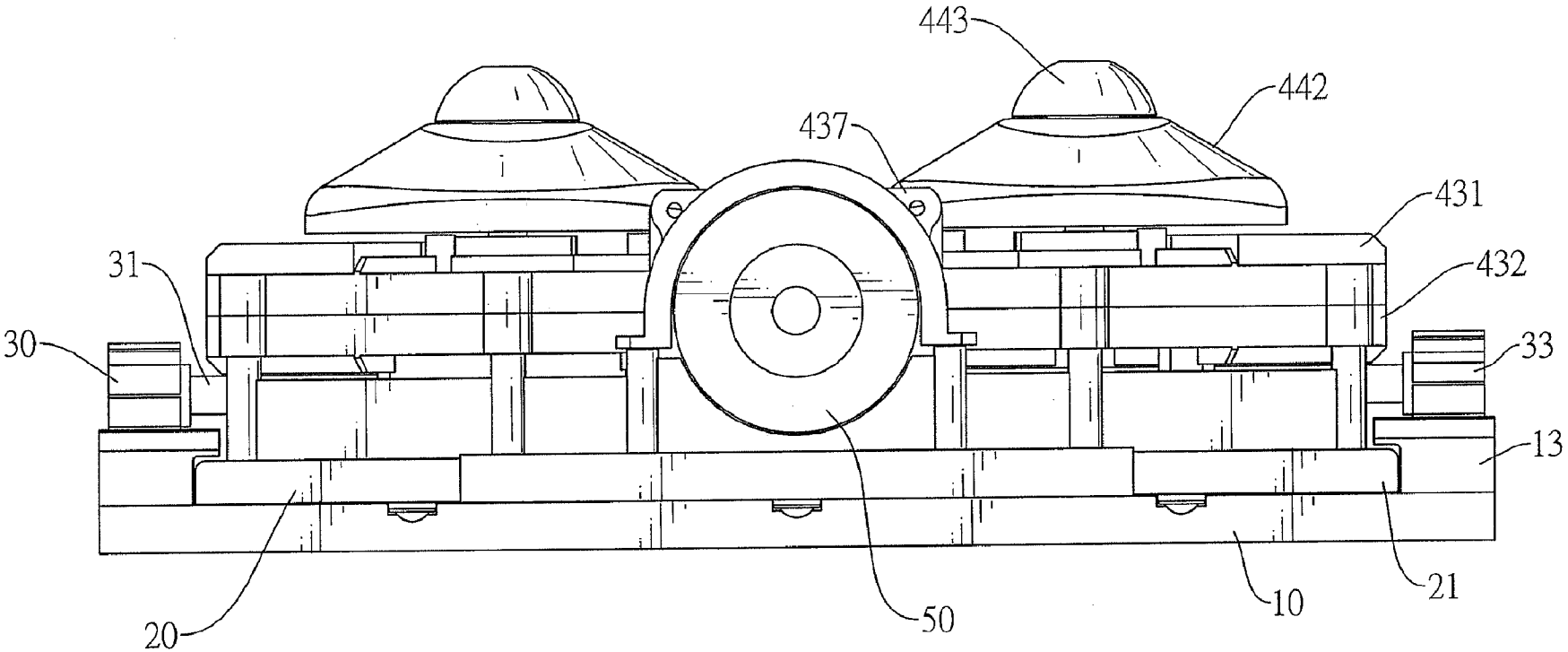
FIG. 2 is a side view of the massager in FIG. 1.
Figure 8:
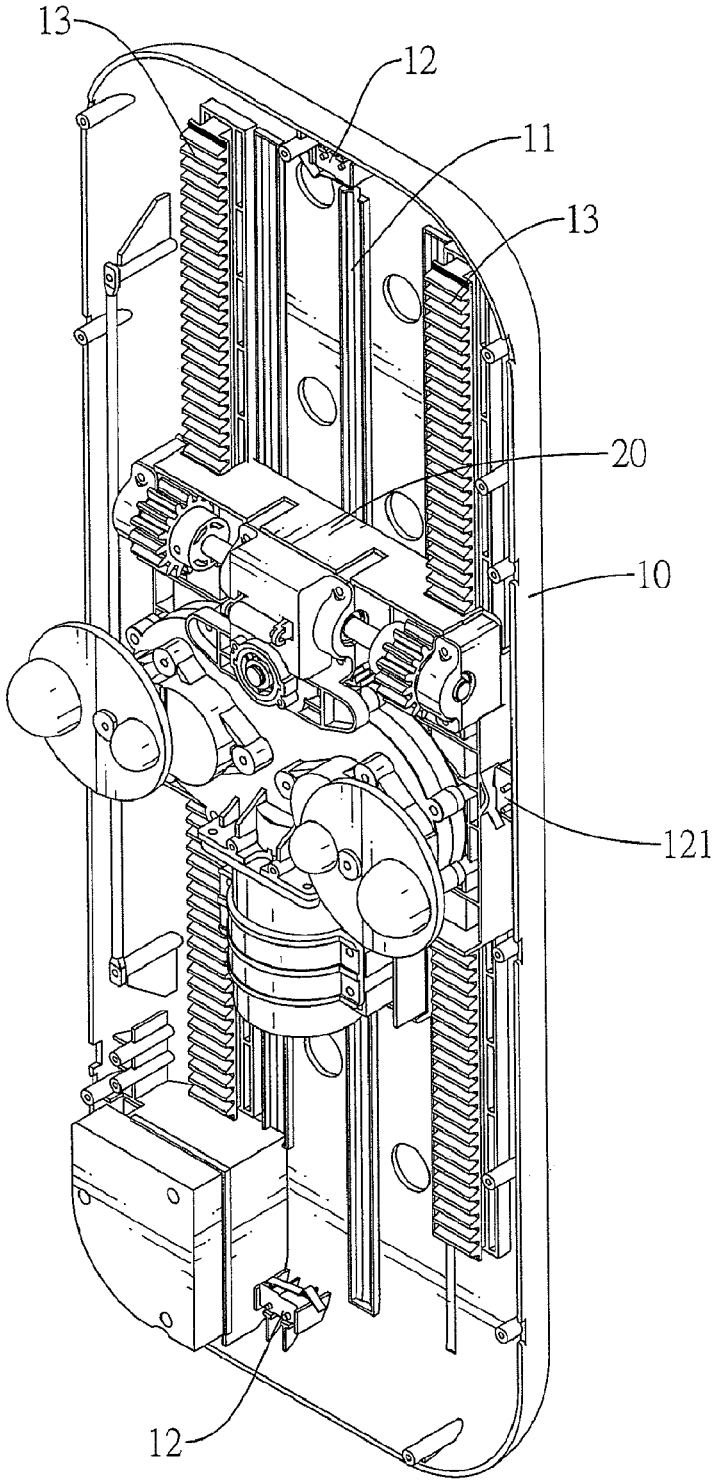
FIG. 8 is a perspective view of the massager in FIG. 7 without an outer cover.

With reference to FIGS. 1, 2 and 8, the base (10) has a top surface, multiple grooves (11), two reverse switches (12), a middle switch (121) and two gear racks (13). The top surface has two ends and two sides. The grooves (11) are formed in the top surface of the base (10) and are parallel to each other grooves (11). The reverse switches (12) are mounted securely on the base (10) and are mounted respectively on the two ends of the top surface of the base (10). The middle switch (121) is mounted on the top surface of the base (10) and is mounted between the reverse switches (12). The gear racks (13) are mounted respectively on the two sides of the top surface of the base (10) and are parallel to the grooves (11).

Figure 9:
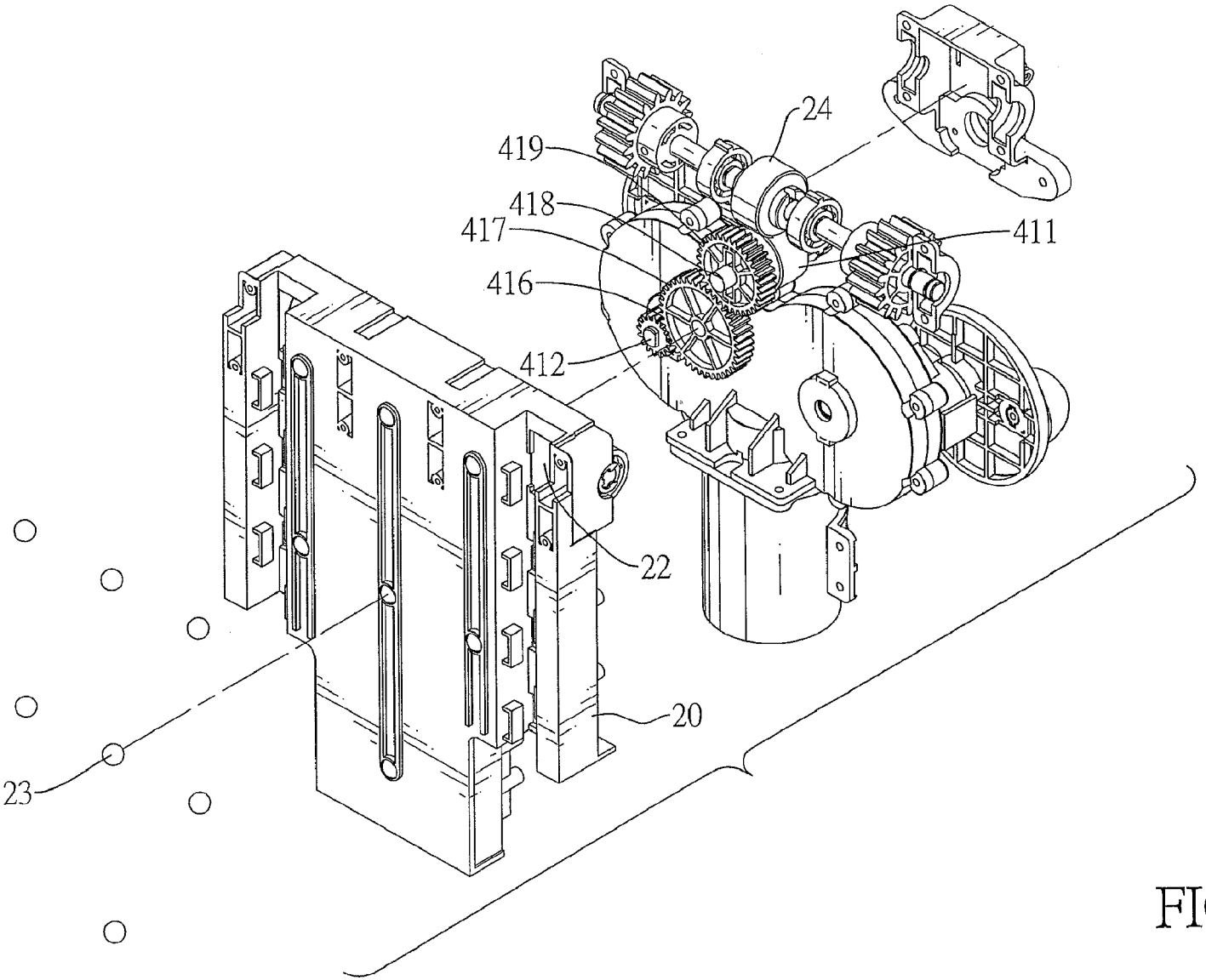
FIG. 9 is an enlarged exploded perspective view of the massager in FIG. 7.

With further reference to FIG. 9, the carriage (20) is mounted movably on the top surface of the base (10). The carriage (20) has a bottom surface, a holder (21), multiple holes (22) and multiple balls (23). The holder (21) is formed on the carriage (20). The bottom surface of the carriage (20) faces the top surface of the base (10). The holes (22) of the carriage (20) are formed in the bottom surface of the carriage (20) and respectively correspond to the grooves (11) of the base (10). Each ball (23) is mounted rotatably in the corresponding hole (22), extends out of the bottom surface of the carriage (20) and are mounted slidably in the corresponding groove (11) of the base (10) to allow the carriage (20) moving along the base (10).

Figure 6:
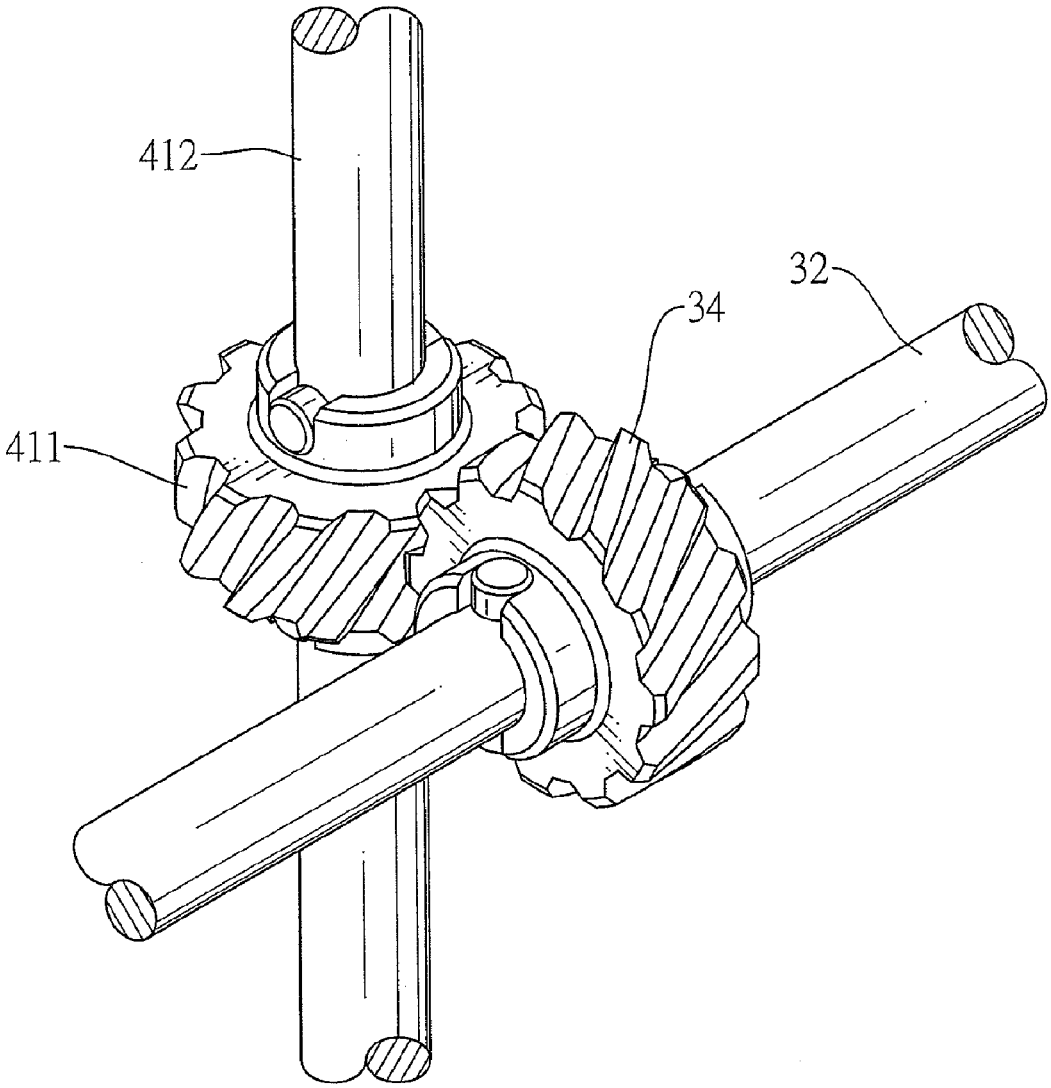
FIG. 6 is a perspective view of the inclined gear of the massage assembly and the inclined gear of the gear shaft assembly of the massager in FIG. 1.
Figure 7:
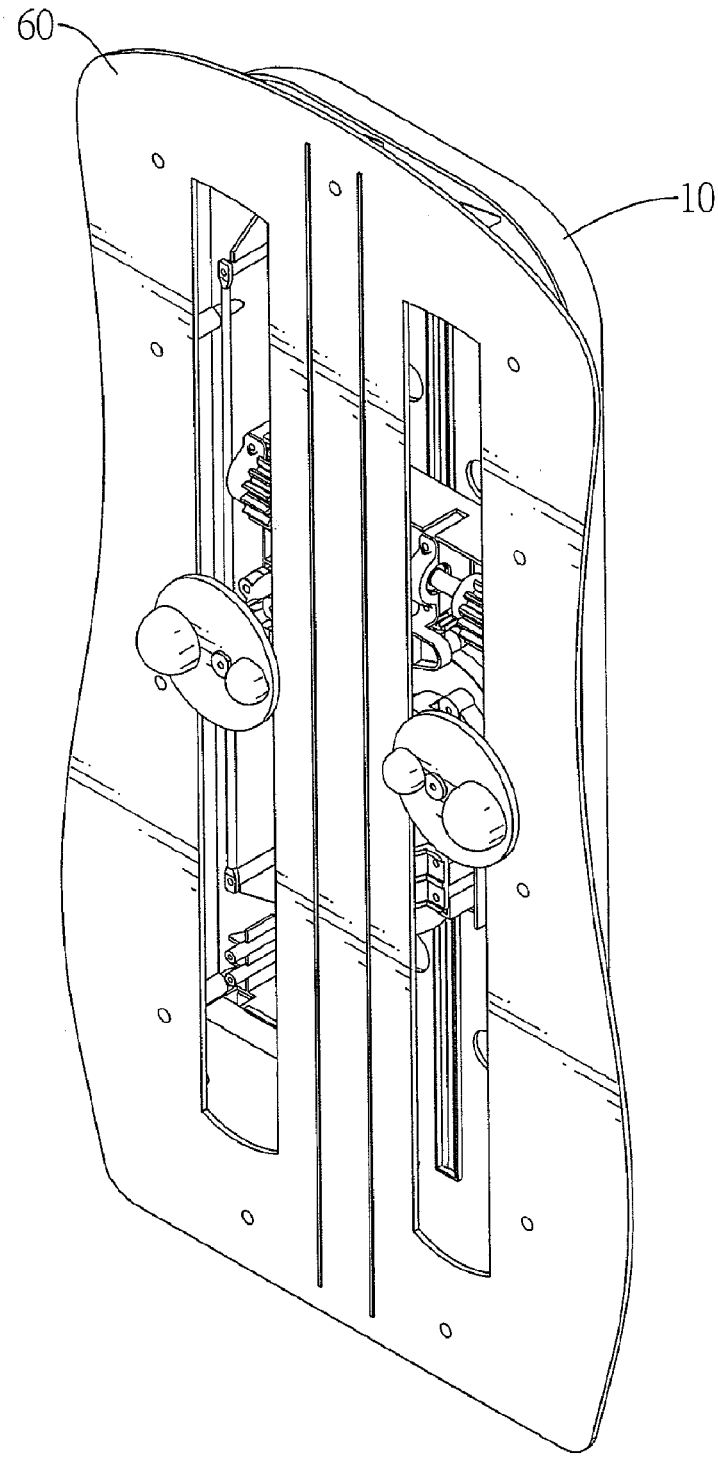
FIG. 7 is a perspective view of another embodiment of a simplified single-motor massager in accordance with the present invention.
Figure 10:
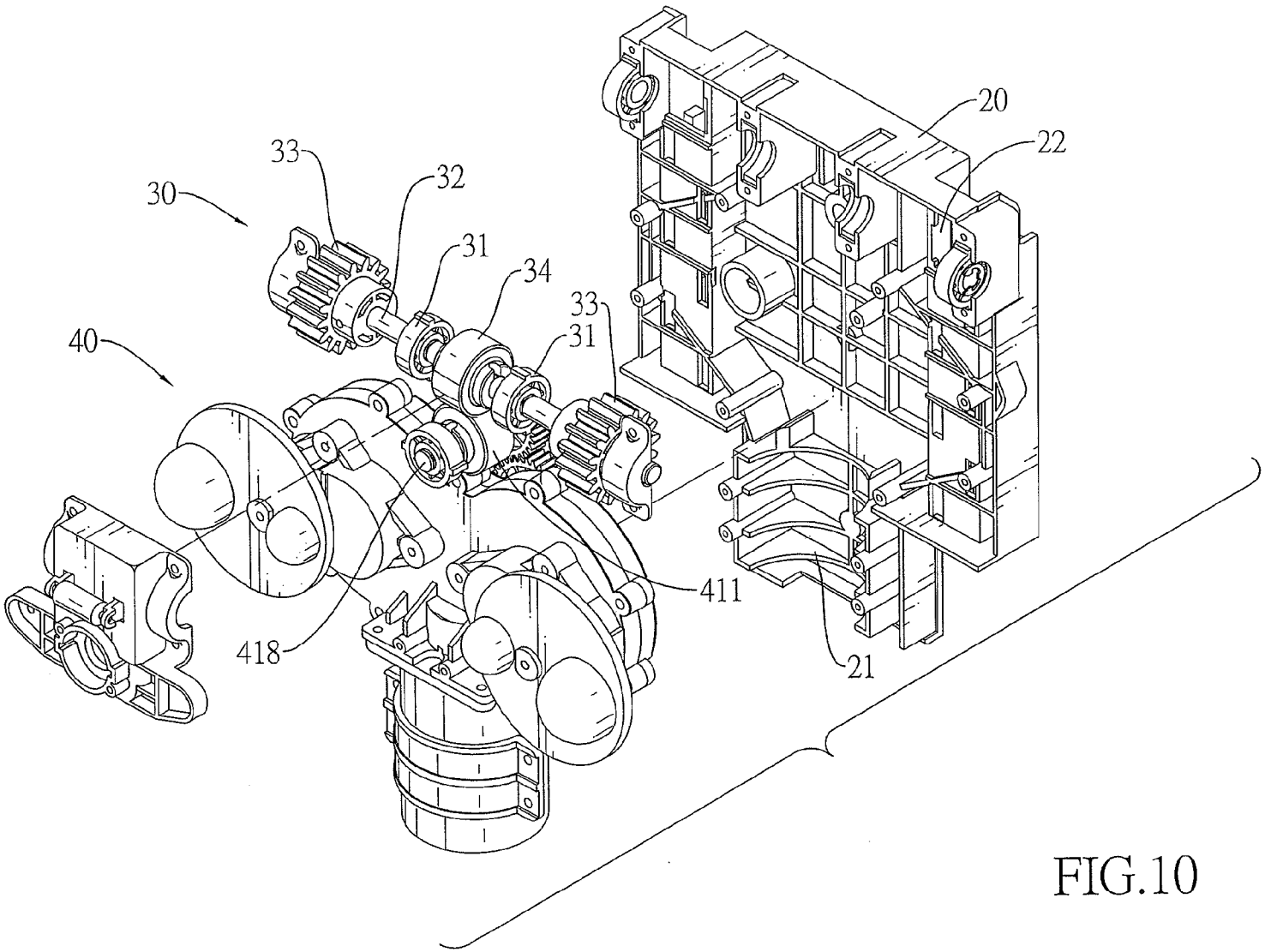
FIG. 10 is another enlarged exploded perspective view of the massager in FIG. 7.

With further reference to FIGS. 6 and 10, the gear shaft assembly (30) is mounted on the carriage (20) and is mounted movably on the gear racks (13) of the base (10). The gear shaft assembly (30) has two bearings (31), a rod (32), two gears (33) and an inclined gear (34). The bearings (31) are mounted separately and securely on the carriage (20). The rod (32) is mounted rotatably on the carriage (20) and extends rotatably through the bearings (31). The rod (32) is mounted across and is perpendicular to the gear racks (13) of the base (10). The rod (32) has two ends. The gears (33) are attached securely and respectively to the two ends of the rod (32) and are respectively adjacent to the bearings (31). The gears (33) are engaged with the gear racks (13) on the base (10). The inclined gear (34) is mounted securely around the rod (32). The inclined gear (34) has teeth inclined with an angle of 45 degrees.

With reference to FIGS. 1 to 4, the massage assembly (40) is mounted on the carriage (20) and comprises a main gear drive (41), a secondary gear drive (42), a housing (43), a main massaging device (44) and a secondary massaging device (45).

The main gear drive (41) connects to the gear shaft assembly (30) and has an inclined gear (411), a rod (412), an end-bearing (413), a gear (414) and a bearing (415). The inclined gear (411) of the main gear drive (41) engages the inclined gear (34) of the gear shaft assembly (30) and has inclined teeth that match with the teeth of the inclined gear (34) of the gear shaft assembly (30). The rod (412) is perpendicular to the carriage (20), drives the inclined gear (411) of the main gear drive (41) and has an upper end and a lower end. The lower end of the rod (412) is adjacent to the carriage (20). The end-bearing (413) is mounted rotatably around the lower end of the rod (412) of the main gear drive (41). The gear (414) is mounted securely around the rod (412) and has a top surface. The bearing (415) is mounted rotatably around the rod (412) and is adjacent to the top surface of the gear (414).

In preferred embodiment as shown in FIG. 1, the rod (412) is mounted securely in and extends through the inclined gear (411) of the main gear drive (41) to drive the inclined gear (411).

In another preferred embodiment as shown in FIG. 9, the main gear drive (41) further has a driven gear (416), a first transfer gear (417), a transfer rod (418) and a second transfer gear (419). The driven gear (416) is mounted securely around the rod (412). The first transfer gear (417) engages the driven gear (416). The transfer rod (418) is mounted rotatably on the carriage (20). The second transfer gear (419) is mounted securely around the transfer rod (418) and engages the first transfer gear (417) and the inclined gear (411). Therefore, the inclined gear (411) is driven by the rod (412) through the driven gear (416), the first transfer gear (417), the transfer rod (418) and the second transfer gear (419).

The secondary gear drive (42) connects to the gear shaft assembly (30) and has a rod (421), an end-bearing (422), a gear (423), and a bearing (424). The rod (421) is parallel to the rod (412) of the main gear drive (41) and has an upper end and a lower end. The lower end is adjacent to the carriage (20). The end-bearing (422) is mounted rotatably around the lower end of the rod (421). The gear (423) is mounted securely around the rod (421) and is adjacent to the end-bearing (422). The gear (423) of the secondary gear drive (42) has a top surface. The bearing (424) is mounted rotatably around the rod (421) of the secondary gear drive (42) and is adjacent to the top surface of the gear (423).

The housing (43) is mounted securely on the carriage (20) and covers the main gear drive (41) and the secondary gear drive (42). The housing (43) has an upper housing portion (431), a lower housing portion (432), a side edge, a main hole (433), a secondary hole (434), a connecting recess (435) a passage (436) and a support (437);

The upper housing portion (431) has an inner surface. The inner surface of the upper housing portion (431) faces the carriage (20). The lower housing portion (432) is adjacent to the carriage (20) and is mounted securely on the carriage (20). The lower housing portion (432) has an inner surface. The inner surface of the lower housing portion (432) faces the upper housing portion (431).

The main hole (433) is formed through the upper housing portion (431) and is mounted around the rod (412) of the main gear drive (41). The secondary hole (434) is formed through the upper housing portion and is mounted around the rod (421) of the secondary gear drive (42);

The connecting recess (435) is formed in the inner surface of the lower housing portion (432) and is mounted around the inclined gear (411) of the main gear drive (41). The end-bearing (413) of the main gear drive (41) is mounted securely in the connecting recess (435), and the inclined gear (411) of the main gear drive (41) is mounted rotatably in the connecting recess (435). The connecting recess (435) has an opening. The opening is corresponding to the inclined gear (34) of the gear shaft assembly (30). The inclined gear (34) of the gear shaft assembly (30) is meshed with the inclined gear (411) of the massage assembly (40) through the opening of the connecting recess (435).

The passage (436) is tubular, is formed in the side edge of the housing (43) and is formed in the inner surface of the upper housing portion (431) and the inner surface of the lower housing portion (432).

The support (437) connects to the side edge of the housing (43) and has an opening. The opening is formed through the support (437) and aligns with the passage (436) of the housing (43).

Figure 11:
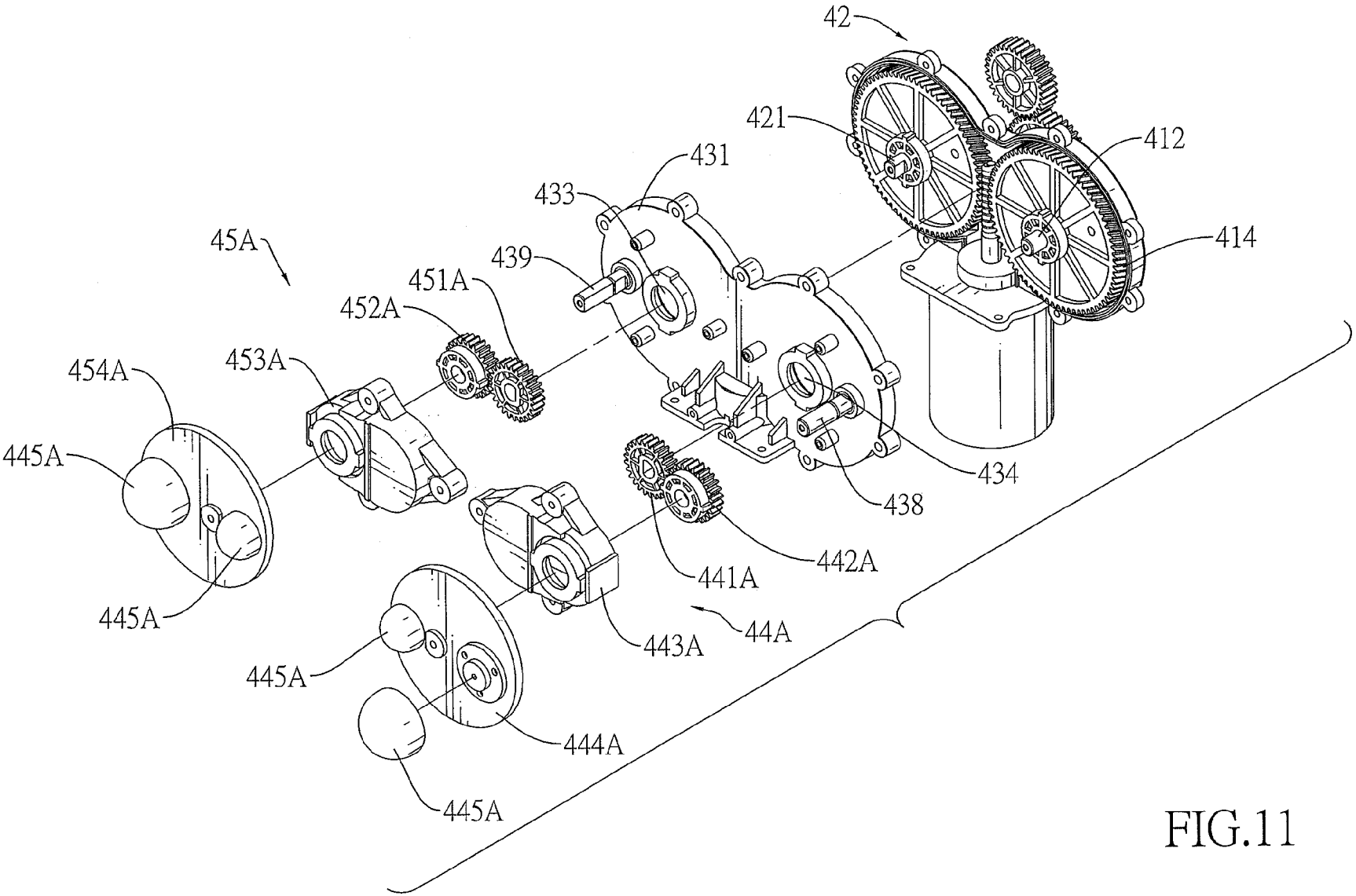
FIG. 11 is an enlarged exploded perspective view of the massaging assembly of the massager in FIG. 7.
Figure 12:
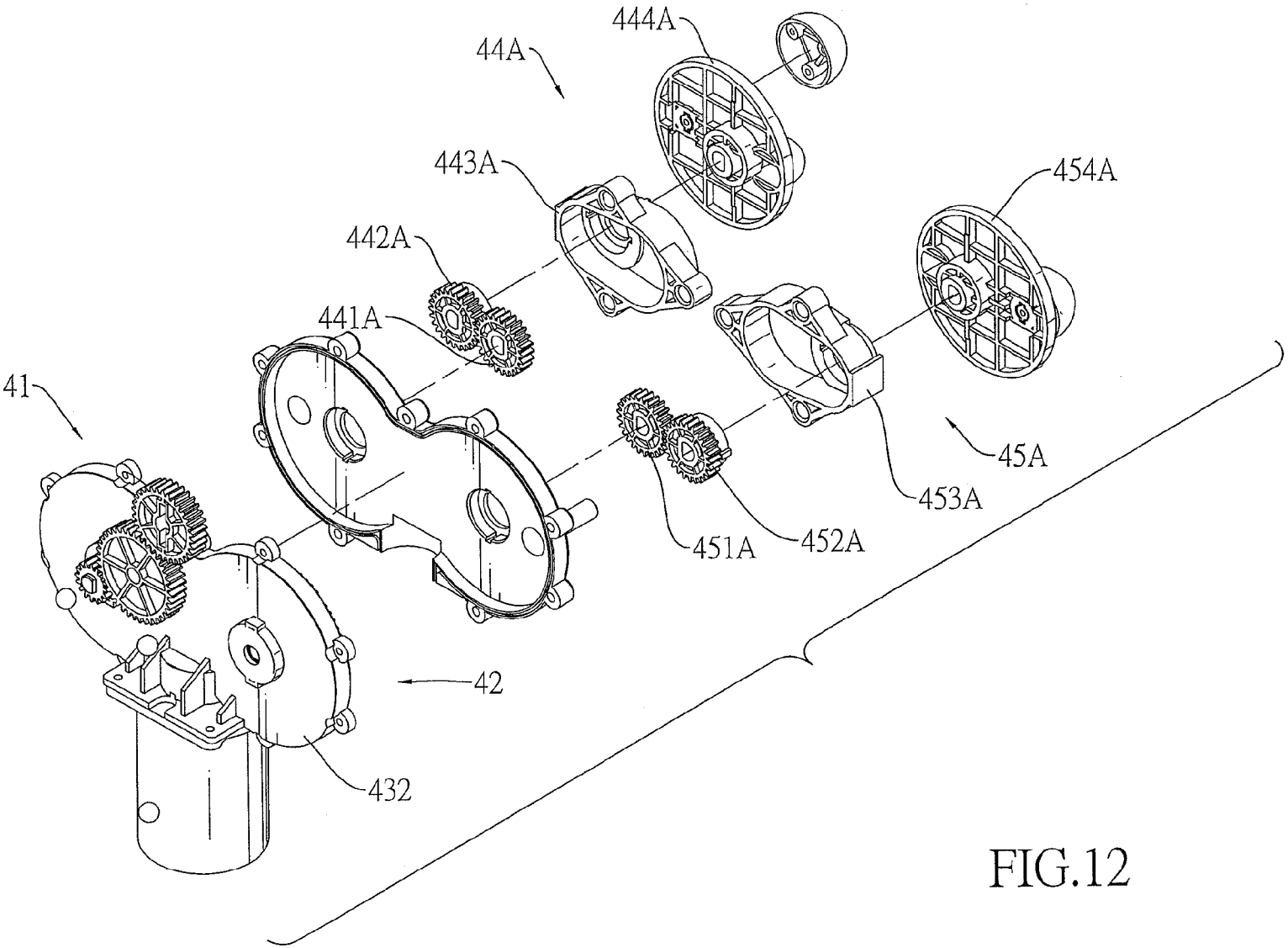
FIG. 12 is another enlarged exploded perspective view of the massaging assembly of the massager in FIG. 7.

In another preferred embodiment as shown in FIGS. 11 and 12, the upper housing portion (431) has a main keyed rod (438) and a secondary keyed rod (439). The keyed rods (438, 439) are formed on and protrude out from the upper housing portion (431).

The main massaging device (44) connects to the main gear drive (41). The main massaging device (44) has a rotating frame (441), a connecting bracket (442) and two nodes (443).

The rotating frame (441) is mounted securely around the rod (412) of the main gear drive (41) and has a bracket and two rods. The bracket has a hole. The hole of the bracket of the rotating frame (441) is mounted securely around the rod (412) of the main gear drive (41) to mount the rotating frame (441) securely around the rod (412) of the main gear drive (41). The rods of the rotating frame (441) are formed separately on the bracket of the rotating frame (441), and each rod has a proximal end. The proximal end of the rod of the rotating frame (441) is formed on the bracket of the rotating frame (441).

The connecting bracket (442) of the main massaging device (44) is mounted securely around the rods of the rotating frame (441) and has two caves and two holes. The caves are formed separately in the connecting bracket (442). The holes of the connecting bracket (442) are formed respectively through the caves of the connecting bracket (442) and are mounted respectively and securely around the rods of the rotating frame (441).

Each node (443) is mounted securely around the corresponding rod of the rotating frame (441), is mounted securely in the corresponding cave of the connecting bracket (442) and has a hole. The hole is formed through the node (443) and is mounted around the corresponding rod of the rotating frame (441).

In another preferred embodiment as shown in FIGS. 11 and 12, the main massaging device (44A) may comprise a transfer gear (441A), a driven gear (442A), a linking bracket (443A), a rotating disk (444A) and two nodes (445A). The transfer gear (441A) is mounted rotatably on the upper housing portion (431) and engages the rod (412) of the main gear drive (41). The driven gear (442A) is mounted rotatably on the upper housing portion (431), engages the transfer gear (441A) of the main massaging device (44A) and is mounted securely around the main keyed rod (438). The linking bracket (443A) is mounted securely on the upper housing portion (431) and is mounted around the transfer gear (441A) and the driven gear (442A) of the main massaging device (44A). The rotating disk (444A) is mounted rotatably on the linking bracket (443A) and is mounted securely around the main keyed rod (438). The nodes (445A) are mounted securely on the rotating disk (444A). Therefore, the rotating disk (444A) is rotated through the rod (412), the transfer gear (441A), and the driven gear (442A). Then the nodes (445A) are rotated to provide massaging function.

The secondary massaging device (45) connects to the secondary gear drive (42). The secondary massaging device (45) has a rotating frame (451), a connecting bracket (452) and two nodes (453).

The rotating frame (451) is mounted securely around the rod (421) of the secondary gear drive (42) and has a bracket and two rods. The bracket has a hole. The hole of the bracket of the rotating frame (451) is mounted securely around the rod (421) of the secondary gear drive (42) to mount the rotating frame (451) securely around the rod (421) of the secondary gear drive (42). The rods are formed separately on the bracket of the rotating frame (451), and each rod has a proximal end. The proximal end of the rod is formed on the bracket of the rotating frame (451).

The connecting bracket (452) of the secondary massaging device (45) is mounted securely around the rods of the rotating frame (451) and has two caves and two holes. The caves are formed separately in the connecting bracket (452). The holes of the connecting bracket (452) are formed respectively through the caves of the connecting bracket (442) and are mounted respectively and securely around the rods of the rotating frame (451).

Each node (453) is mounted securely around the corresponding rod of the rotating frame (451), is mounted securely in the caves of the connecting bracket (452) and has a hole. The hole is formed through the node (453) and is mounted around the corresponding rod of the rotating frame (451).

In another preferred embodiment as shown in FIGS. 11 and 12, the secondary massaging device (45A) may comprise a transfer gear (451A), a driven gear (452A), a linking bracket (453A), a rotating disk (454A) and two nodes (455A). The transfer gear (451A) is mounted rotatably on the upper housing portion (431) and engages the rod (421) of the secondary gear drive (42). The driven gear (452A) is mounted rotatably on the upper housing portion (431), engages the transfer gear (451A) of the secondary massaging device (45A) and is mounted securely around the secondary keyed rod (439). The linking bracket (453A) is mounted securely on the upper housing portion (431) and is mounted around the transfer gear (451A) and the driven gear (452A) of the secondary massaging device (45A). The rotating disk (454A) is mounted rotatably on the linking bracket (453A) and is mounted securely around the secondary keyed rod (439). The nodes (455A) are mounted securely on the rotating disk (454A). Therefore, the rotating disk (454A) is rotated through the rod (421), the transfer gear (451A), and the driven gear (452A). Then the nodes (455A) are rotated to provide massaging function.

The motor (50) is mounted securely in the support (437) of the housing (43) and is mounted securely on the holder (21) of the carriage (20). The motor (50) has a worm rod (51) and a block (52).

The worm rod (51) extends out of the motor (50) and extends through the opening of the support (437). The worm rod (51) is mounted rotatably in the passage (436) of the housing (43) and is meshed with the gear (414) of the main gear drive (41) and the gear (423) of the secondary gear drive (42). The block (52) has a front surface. The front surface faces the housing (43). The front surface of the block (52) is mounted securely on the support (437) of the massage assembly (40).

Figure 3:
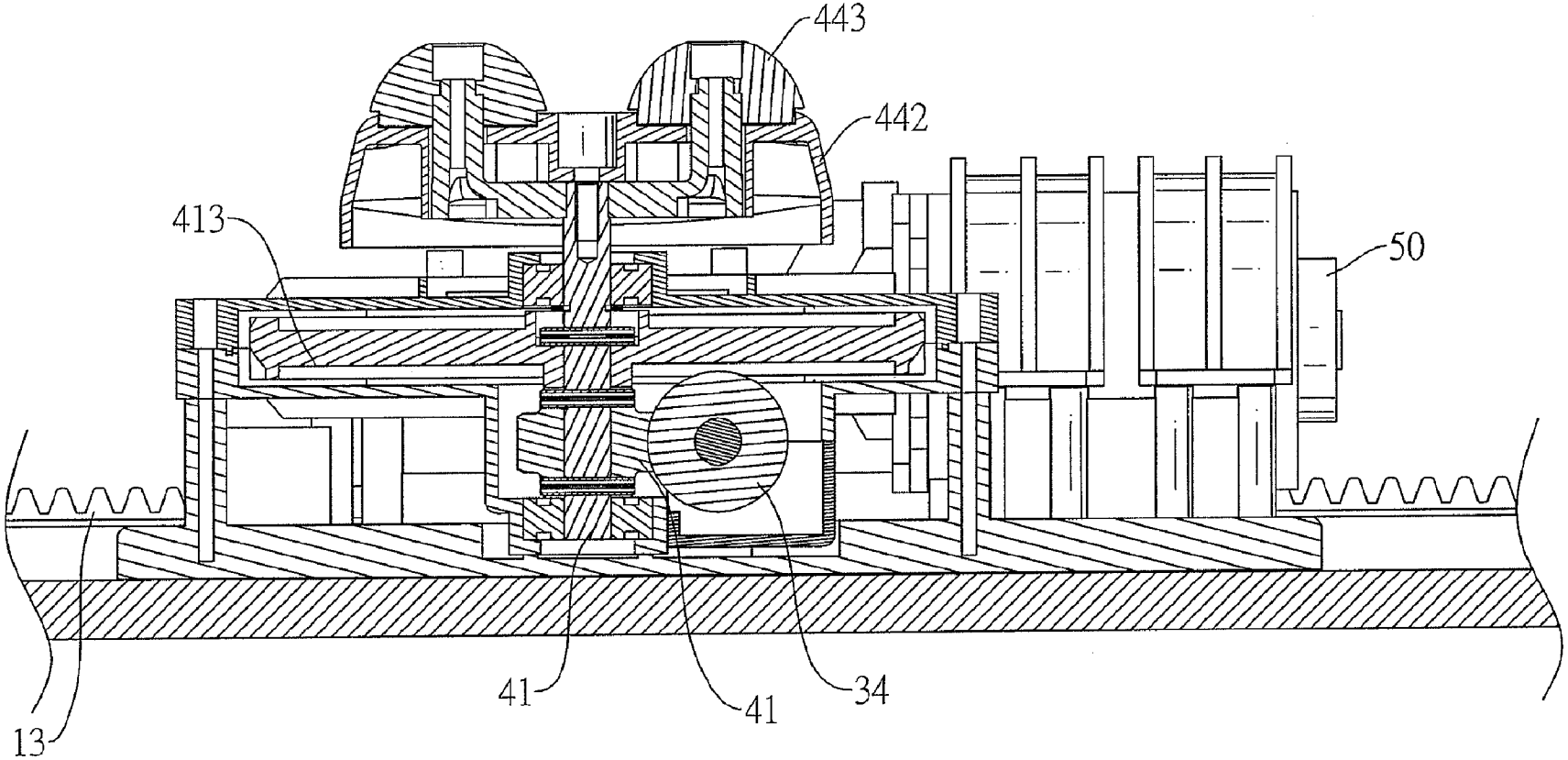
FIG. 3 is an operational side view in partial section of the massager in FIG. 1.
Figure 4:
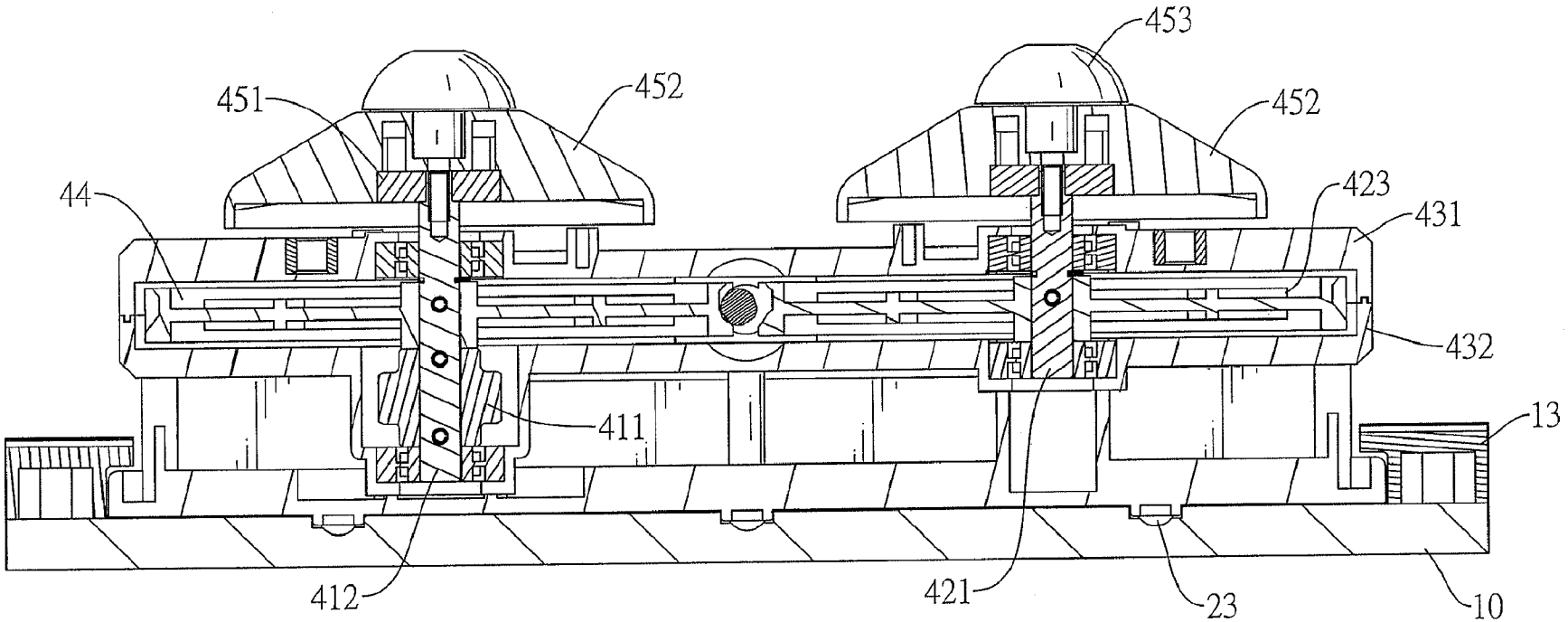
FIG. 4 is an operational front view in partial section of the massager in FIG. 1.

With reference to FIGS. 1 and 3, when the motor (50) is turned on, the worm rod (51) is rotated. The worm rod (51) rotates the gear (414) of the main gear drive (41) and the gear (423) of the secondary gear drive (42). Then the gear (414) of the main gear drive (41) and the gear (423) of the secondary gear drive (42) respectively rotate the main massaging device (44) and the secondary massaging device (45) via the rods (411, 421) of the main and secondary gear drives (41, 42).

With further reference to FIG. 6, because the inclined gear (34) of the gear shaft assembly (30) is meshed with the inclined gear (411) of the massage assembly (40), the gear (414) of the main gear drive (41) rotates the inclined gear (411) of the massage assembly (40). Then the inclined gear (34) of the gear shaft assembly (30) rotates the gears (33) of the gear shaft assembly (30) and the balls (23) of the carriage (20) slide in the grooves (11) of the base (10). Therefore, the gears (33) are allowed to move along the gear racks (13) on the base (10).

Figure 5:
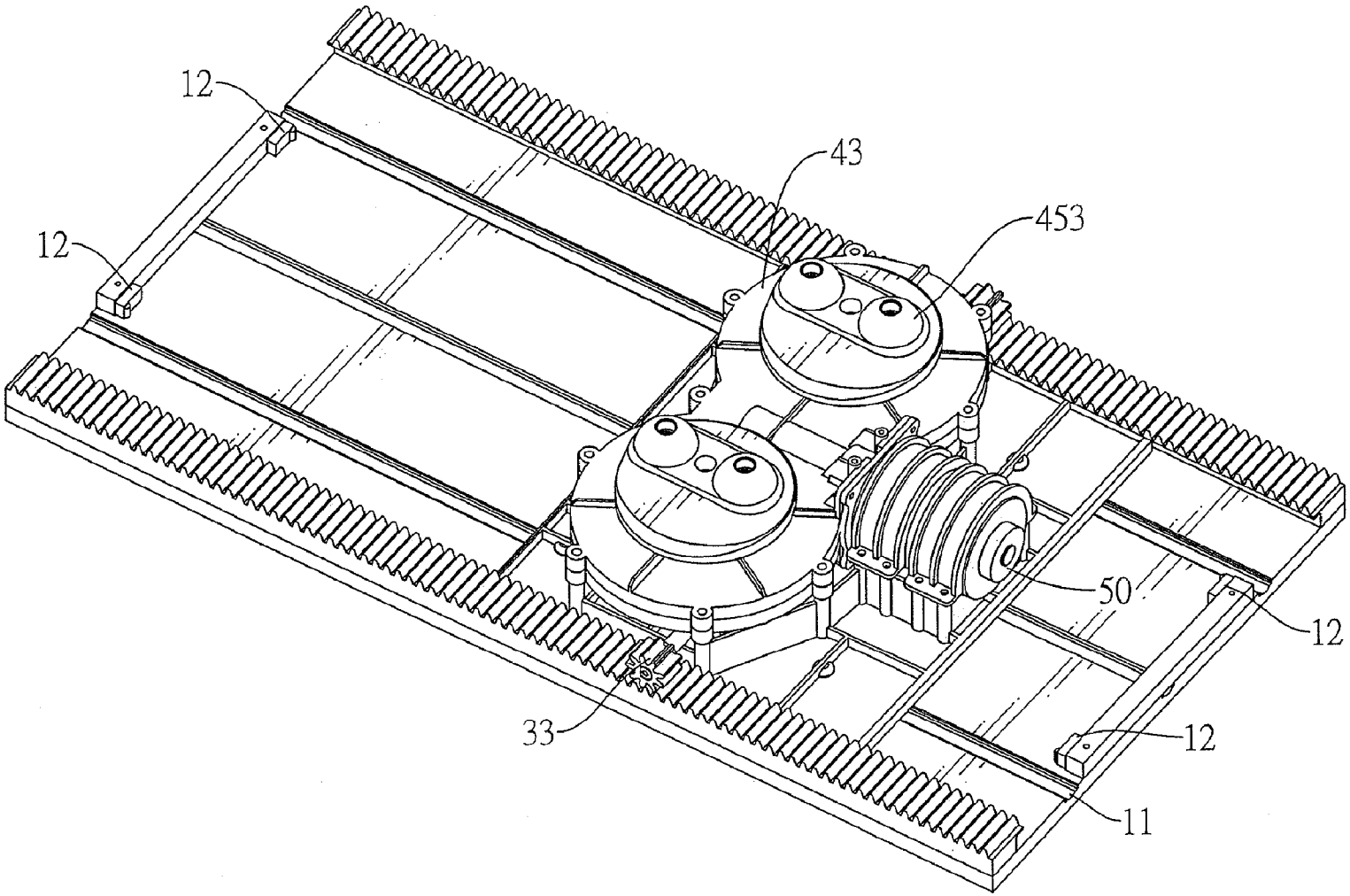
FIG. 5 is a perspective view of the massager in FIG. 1.

With reference to FIGS. 1, 3 and 5, when an user turn on the single-motor massager, the motor (50) rotates the main massaging device (44) and the secondary massaging device (45) of the massage assembly (40). So the rotating nodes (443) provide the user a massage function. Furthermore, the main gear drive (41) of the massage assembly (40) drives the gear shaft assembly (30) to move along the two gear racks (13) on the base (10). Therefore, the single-motor massager in accordance with the present invention provides a large area massage function. When the carriage (20) reaches the reverse switches (12) of the base (10), the motor (50) reversed. Then the main gear drive (41) and the massage assembly (40) is reversed, and the gears (33) of the carriage (30) is driven to move backward, and the nodes (433) reverse simultaneously. Furthermore, the user may let the carriage (20) move between the middle switch (121) and one of the reverse switch (12) to provide massaging function especially direct to the upper back or the lower back of the human body.

Because the gear racks (13) are in pair and set equally, the gear shaft assembly (30) moves along the gear racks (13) smoothly and steady.

Moreover, only one motor (50) and two gear drives (41, 42) are needed, the manufacturing process of the massager is simplified and the cost of the massager is reduced.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A single-motor massager comprising:

a base having a top surface having two ends; and two sides; and two gear racks mounted respectively on the two sides of the top surface of the base and being parallel to each other;

a carriage mounted movably on the top surface of the base;

a gear shaft assembly mounted on the carriage, mounted movably on the gear racks of the base and comprising a rod mounted rotatably on the carriage, mounted across and being perpendicular to the gear racks of the base and having two ends;

two gears attached securely respectively to the two ends of the rod and engaged with the gear racks of the base; and an inclined gear mounted securely around the rod and having inclined teeth;

a massage assembly mounted on the carriage and comprising a main gear drive connecting to the gear shaft assembly and having an inclined gear engaging the inclined gear of the gear shaft assembly;

a rod driving the inclined gear of the main gear drive; and a gear mounted securely around the rod of the main gear drive and having a top surface; and a main massaging device connecting to the main gear drive and being rotated by the rod of the main gear drive; and a motor mounted securely on the carriage and having a worm rod extending out of the motor and meshed with the gear of the main gear drive.

2. The massager as claimed in claim 1, wherein the massage assembly has a secondary gear drive, connecting to the gear shaft assembly, parallel to the main gear drive and having a rod being parallel to the rod of the main gear drive and having a lower end; and a gear mounted securely around the rod of the secondary gear drive, meshed with the worm rod of the motor and having a top surface; and a secondary massaging device connecting to the secondary gear drive.

3. The massager as claimed in claim 1, wherein the base has multiple grooves formed in the top surface of the base and being parallel to each other; and the carriage has a bottom surface facing the top surface of the base;

multiple holes formed in the bottom surface of the carriage and respectively corresponding to the grooves of the base; and multiple balls, and each ball mounted rotatably in one of the holes of the carriage, extending out of the bottom surface of the carriage and mounted slidably in a corresponding groove of the base.

4. The massager as claimed in claim 2, wherein the base has multiple grooves formed in the top surface of the base and being parallel to each other; and the carriage has a bottom surface facing the top surface of the base;

multiple holes formed in the bottom surface of the carriage and respectively corresponding to the grooves of the base; and multiple balls, and each ball mounted rotatably in one of the holes of the carriage, extending out of the bottom surface of the carriage and mounted slidably in a corresponding groove of the base.

5. The massager as claimed in claim 1, wherein the massage assembly has a housing mounted securely on the carriage, covering the main gear drive and having an upper housing portion;

a lower housing portion mounted on the carriage;

a side edge;

a main hole formed through the upper housing portion and mounted around the rod of the main gear drive;

a connecting recess formed in the inner surface of the lower housing portion, mounted around the inclined gear of the main gear drive and having an opening corresponding to the inclined gear of the gear shaft assembly;

a passage being tubular and formed in the side edge of the housing; and a support connecting to the side edge of the housing and having an opening formed through the support and aligning with the passage;

the motor is mounted securely in the support of the housing; and the worm rod extends through the opening of the support and is mounted rotatably in the passage of the housing.

6. The massager as claimed in claim 4, wherein the massage assembly has a housing mounted securely on the carriage, covering the main gear drive and having an upper housing portion;

a lower housing portion mounted on the carriage;

a side edge;

a main hole formed through the upper housing portion and mounted around the rod of the main gear drive;

a connecting recess formed in the inner surface of the lower housing portion, mounted around the inclined gear of the main gear drive and having an opening corresponding to the inclined gear of the gear shaft assembly;

a passage being tubular and formed in the side edge of the housing; and a support connecting to the side edge of the housing and having an opening formed through the support and aligning with the passage;

the motor is mounted securely in the support of the housing; and the worm rod extends through the opening of the support and is mounted rotatably in the passage of the housing.

7. The massager as claimed in claim 1, wherein the inclined gear of the gear shaft assembly has teeth inclined with an angle of 45 degrees.

8. The massager as claimed in claim 6, wherein the inclined gear of the gear shaft assembly has teeth inclined with an angle of 45 degrees.

9. The massager as claimed in claim 1, wherein the main massaging device has a rotating frame mounted securely around the rod of the main gear drive and having a bracket having a hole mounted securely around the rod of the main gear drive; and two rods formed separately on the bracket of the rotating frame;

a connecting bracket mounted securely around the rods of the rotating frame and having two caves formed separately in the connecting bracket; and two holes formed respectively through the caves and mounted respectively securely around the rods of the rotating frame; and two nodes, and each node mounted securely around a corresponding rod of the rotating frame, mounted securely in a corresponding cave of the connecting bracket and having a hole formed through the node and mounted around the corresponding rod of the rotating frame.

10. The massager as claimed in claim 8, wherein the main massaging device has a rotating frame mounted securely around the rod of the main gear drive and having a bracket having a hole mounted securely around the rod of the main gear drive; and two rods formed separately on the bracket of the rotating frame;

a connecting bracket mounted securely around the rods of the rotating frame and having two caves formed separately in the connecting bracket; and two holes formed respectively through the caves and mounted respectively securely around the rods of the rotating frame; and two nodes, and each node mounted securely around a corresponding rod of the rotating frame, mounted securely in a corresponding cave of the connecting bracket and having a hole formed through the node and mounted around the corresponding rod of the rotating frame; and the secondary massaging device having a rotating frame mounted securely around the rod of the secondary gear drive and having a bracket having a hole mounted securely around the rod of the secondary gear drive; and two rods formed separately on the bracket of the rotating frame of the secondary massaging device;

a connecting bracket mounted securely around the rods of the rotating frame of the secondary massaging device and having two caves formed separately in the connecting bracket of the secondary massaging device; and two holes formed respectively through the caves of the connecting bracket of the secondary massaging device and mounted respectively securely around the rods of the rotating frame of the secondary massaging device; and two nodes, and each node mounted securely around a corresponding rod of the rotating frame of the secondary massaging device, mounted securely in a corresponding cave of the connecting bracket of the secondary massaging device and having a hole formed through the node and mounted around the corresponding rod of the rotating frame of the secondary massaging device.

11. The massager as claimed in claim 1, wherein the base has two reverse switches mounted securely on the base and mounted respectively on the two ends of the top surface of the base.

12. The massager as claimed in claim 10, wherein the base has two reverse switches mounted securely on the base and mounted respectively on the two ends of the top surface of the base.

13. The massager as claimed in claim 1, wherein the carriage has a holder formed on the carriage; and the motor is mounted securely on the holder of the carriage.

14. The massager as claimed in claim 12, wherein the carriage has a holder formed on the carriage; and the motor is mounted securely on the holder of the carriage.

15. The massager as claimed in claim 14, wherein the motor has a block mounted securely on the support of the housing of the massage assembly.

16. The massager as claimed in claim 1, wherein the massage assembly has a housing mounted securely on the carriage, covering the main gear drive and having an upper housing portion; and a main keyed rod formed on and protruding out from the upper housing portion; and the main massaging device comprising a transfer gear mounted rotatably on the upper housing portion and engaging the rod of the main gear drive;

a driven gear mounted rotatably on the upper housing portion, engaging the transfer gear of the main massaging device and mounted securely around the main keyed rod;

a linking bracket mounted securely on the upper housing portion and mounted around the transfer gear and the driven gear of the main massaging device;

a rotating disk mounted rotatably on the linking bracket and mounted securely around the main keyed rod; and two nodes mounted securely on the rotating disk.

17. The massager as claimed in claim 16, wherein the housing of the massage assembly further has a secondary keyed rod formed on and protruding out from the upper housing portion; and the massage assembly has a secondary gear drive, connecting to the gear shaft assembly, parallel to the main gear drive and having a rod being parallel to the rod of the main gear drive and having a lower end; and a gear mounted securely around the rod of the secondary gear drive, meshed with the worm rod of the motor and having a top surface; and a secondary massaging device comprises a transfer gear mounted rotatably on the upper housing portion and engaging the rod of the secondary gear drive;

a driven gear mounted rotatably on the upper housing portion, engaging the transfer gear of the secondary massaging device and mounted securely around the secondary keyed rod;

a linking bracket mounted securely on the upper housing portion and mounted around the transfer gear and the driven gear of the secondary massaging device;

a rotating disk mounted rotatably on the linking bracket of the secondary massaging device and mounted securely around the secondary keyed rod; and two nodes mounted securely on the rotating disk of the secondary massaging device.

18. The massager as claimed in claim 1, wherein the rod of the main gear drive is mounted securely in and extends through the inclined gear of the main gear drive.

19. The massager as claimed in claim 1, wherein the main gear drive further has a driven gear mounted securely around the rod of the main gear drive;

a first transfer gear engaging the driven gear of the main gear drive;

a transfer rod mounted rotatably on the carriage;

a second transfer gear mounted securely around the transfer rod of the main gear drive and engaging the first transfer gear and the inclined gear of the main gear drive.

20. The massager as claimed in claim 12, wherein the base has a middle switch mounted on the top surface of the base and mounted between the reverse switches.

* * * * *